United States Patent [19]

Haushalter

[11] Patent Number: 4,756,747

[45] Date of Patent: Jul. 12, 1988

[54] SYNTHESIS OF NEW AMORPHOUS METALLIC SPIN GLASSES

[75] Inventor: Robert C. Haushalter, Clinton, N.J.

[73] Assignee: The United States of America as represented by the Department of Energy, Washington, D.C.

[21] Appl. No.: 889,066

[22] Filed: Jul. 24, 1986

Related U.S. Application Data

[62] Division of Ser. No. 700,845, Feb. 11, 1985, Pat. No. 4,626,296.

[51] Int. Cl.[4] ..... C22C 38/00; C22C 19/07

[52] U.S. Cl. ..... 75/0.5 A; 75/0.5 AA; 75/0.5 R; 148/403; 420/84; 420/435; 420/557; 420/579

[58] Field of Search ..... 75/0.5 A, 0.5 AA, 0.5 R; 148/403; 420/84, 435, 557, 579

[56] References Cited

U.S. PATENT DOCUMENTS

| | | | |
|---|---|---|---|
| 3,940,470 | 2/1976 | Kane et al. | 75/0.5 A |
| 4,064,757 | 12/1977 | Hasegawa | 73/362 AR |
| 4,116,682 | 9/1978 | Pock et al. | 148/403 |
| 4,126,449 | 11/1978 | Tanner et al. | 75/164 |
| 4,144,058 | 3/1979 | Chen et al. | 75/170 |
| 4,152,144 | 5/1979 | Hasegawa | 75/122 |
| 4,188,211 | 2/1980 | Yamaguchi et al. | 75/170 |
| 4,209,570 | 6/1980 | Decristofard et al. | 428/606 |
| 4,225,339 | 9/1980 | Inomata et al. | 75/122 |
| 4,253,870 | 3/1981 | Decristofard et al. | 75/159 |
| 4,255,189 | 3/1981 | Ray | 75/123 E |
| 4,389,262 | 6/1983 | Tanner | 148/403 |
| 4,585,617 | 4/1986 | Tenhover et al. | 75/0.5 A |
| 4,626,296 | 12/1986 | Haushalter | 420/557 |

OTHER PUBLICATIONS

Haushalter et al., "Spin Glass Behavior in the New Amorphous Alloys $M_2SnTe_4$ (M=Cr, Mn, Fe)", Solid State Communications, 49, No. 10, pp. 929–933, 3–84.

Haushalter et al., "Synthesis of Amorphous Metal in Spin Glass $M_2SnTe_4$ (M=Cr, Mn, Fe, Co) Solvent Induced Metal Insulator Transformations", International Edition, 23, 2–25–85.

*Primary Examiner*—Anthony McFarlane

*Attorney, Agent, or Firm*—William Lohff; James W. Weinberger; Judson R. Hightower

[57] ABSTRACT

Amorphous metallic precipitates having the formula $(M_1)_a(M_2)_b$ wherein $M_1$ is at least one transition metal, $M_2$ is at least one main group metal and the integers "a" and "b" provide stoichiometric balance; the precipitates having a degree of local order characteristic of chemical compounds from the precipitation process and useful electrical and mechanical properties.

4 Claims, No Drawings

SYNTHESIS OF NEW AMORPHOUS METALLIC SPIN GLASSES

CONTRACTUAL ORIGIN OF THE INVENTION

The United States Government has rights in this invention pursuant to Contract No. W-31-109-ENG-38 between the U.S. Department of Energy and The University of Chicago representing Argonne National Laboratory.

This is a division of application Ser. No. 700,845, filed 2/11/86, now U.S. Pat. No. 4,626,296.

BACKGROUND OF THE INVENTION

This invention relates to amorphous, metallic spin glasses and more particularly to amorphous, metallic precipitates having the formula $(M_1)_a(M_2)_b$ wherein $M_1$ is at least one transition metal, $M_2$ is at least one main group metal and the integers "a" and "b" provide stoichiometric balance. The compound $Fe_2SnTe_4$ provides an illustration of the composition.

As reported in U.S. Pat. Nos. 4,255,189; 4,365,994; 4,389,262; and 4,374,665; amorphous metallic alloys have been identified with certain beneficial mechanical and electrical properties. As set forth in U.S. Pat. Nos. 4,255,189 and 4,365,994, alloys identified as spin glasses have been prepared by rapid quenching techniques and in some instances by sputtering or vapor deposition. In general, the resulting alloys are characterized by a random distribution of the metals forming the alloy. While these compositions are of interest in this developing technology, new metallic compositions are desirable to provide additional properties.

Accordingly, one object of the invention is a class of new amorphous metallic compositions. Another object is an amorphous metallic spin glass having properties useful in fabricating products.

SUMMARY OF THE INVENTION

Briefly the invention is directed to amorphous metallic compositions characterized as precipitates and having the formula $(M_1)_a(M_2)_b$ wherein $M_1$ is at least one transition metal, $M_2$ is at least one main group metal and the integers "a" and "b" provide stoichiometric balance.

As precipitates formed from chemical compounds, these compositions retain a degree of local order from the starting compounds. As an illustration, $Fe_2SnTe_4$ retains the ordered structure of the $SnTe_4$ moiety (a tetrahedron) whereas a liquid metallic mixture of Fe, Sn and Te would normally have the metals in a random arrangement. These compositions as chemical precipitates are further characterized by a degree of electron transfer between the main group metal and the transition metal. The resulting precipitates therefore may retain some charge separation characteristics or may exist in neutral form. By controlling the amount of electron transfer during the precipitation step (usually by the selection of the metals or by mixtures of the metal cations), electrical properties such as electrical resistivity may be controlled. As an illustration, $Mn^{2+}$ is more difficult to reduce than metals such as $Co^{2+}$. In $Mn_2SnTe_4$, there is a partial electron transfer from the anion to cation resulting in $Mn_2SnTe_4$ being a semiconductor with a resistivity at 300° K. being about 1 ohm cm for pressed powder samples. With $Co_2SnTe_4$, there is a greater electron transfer to provide a zero-valent state and the product ($Co_2SnTe_4$) is metallic with a resistivity at 300° K. of about $10^{-4}$ ohm cm for pressed powder samples. Accordingly, these compositions are characterized by the compound form wherein $M_1$ and $M_2$ may have charge characteristics or exist as the neutral form.

In preferred embodiments of the invention, these precipitates have the formula $(M_1)_2SnTe_4$ where $M_1$ is Cr, Mn, Fe or Co, are malleable and may be easily formed into flat sheets and other fabricated shapes for industrial use. The invention is further directed to the process of preparing these compositions by the steps of mixing the following compositions $M_1X$ and $YM_2$ in a suitable solvent, wherein $M_1$ and $M_2$ are as previously defined and the composition YX is soluble in the solvent, and forming a precipitate of $(M_1)_a(M_2)_b$.

DETAILED DESCRIPTION OF THE PREFERRED EMBODIMENT

Previously, applications for "Electroless Metal Plating of Plastics" filed Sept. 20, 1982, now U.S. Pat. No. 4,459,330 and "Chemical Synthesis of Thin Films and Supported Crystals by Oxidation of Zintl Anions", filed Jan. 4, 1983, Ser. No. 455,614, have been directed to the preparation of metallic coatings of main group metals and/or transition metals on substrates. The disclosure of these applications by reference thereto, is hereby incorporated herein. In some deposition techniques, a reagent such as $K_4SnTe_4$ has been used. The resultant metallic coating usually was the main group metal such as Sn or a layer of the main group metal overlaid with a transition metal separately deposited. Applicant has found that the main group metal may be combined with a transition metal in compound form and solidified by precipitation from a solution of alcohol or other solvent to provide a metallic composition having properties useful for industrial products.

The invention composition is characterized by the formula $(M_1)_a(M_2)_b$ wherein $M_1$ is at least one transition metal, $M_2$ is at least one main group metal and the integers "a" and "b" provide stoichiometric balance. Suitably, the transition metal has an atomic number in the range of 24–30, 45–48 and 77–80. More particularly, $M_1$ is Cr, Mn, Fe, Co, Zn, Cu, Ni, Ag, Au, Pd, Ru, Pt, Hg, Rh or a mixture of the metals. Compositions with the transition metal is Cr, Mn, Fe, Co or mixtures thereof are preferred. Suitably, the main group metal may be Sn, Pb, As, Sb, P, Te, Se, S or mixtures thereof such as $SnTe_4$. Sn, Pb, Te and mixtures thereof are preferred. In the starting materials, the preferred valence state of the transition and main group metals are $Cr^{2+}$, $Mn^{2+}$, $Fe^{2+}$, $Co^{2+}$, $Zn^{2+}$, $Cu^{2+}$, $Ni^{2+}$, $Ag^{1+}$, $Au^{1+}$, $Pd^{2+}$, $Pt^{2+}$, $Hg^{2+}$, $Rh^{3+}$, $Sn_9^{4-}$, $Pb_9^{4-}$, $As_7^{3-}$, $Sb_7^{3-}$, $P_7^{3-}$, $Te_5^{2-}$, $Sc_6^{2-}$, and $S_6^{2-}$. Accordingly, the values of "a" and "b" will vary between in a ratio of 2:3–4:1.

As precipitates, the compositions may be obtained as very fine particulates which are usually malleable and may be pressed into the desired shape. The more metallic products (e.g., $Co_2SnTe_4$) have low electrical resistivities. The compositions are also characterized by the ordered structure associated with the resulting composition formed in the precipitation or at least one of the ions as in $Fe_2SnTe_4$.

The composition $(M_1)_2SnTe_4$ where $M_1$ is Cr, Mn, Fe or Co may be converted to other compositions by the thermal decomposition of $SnTe_4$. With $Fe_2SnTe_4$, thermal decomposition by heating at about 600° C. for about 24 hours yields $FeTe_2$+ FeTe+ SnTe. Products of $(M_1)_2SnTe_4$ therefore may be useful for detecting a high temperature excursion by the change in properties.

These compositions are prepared by combining $M_1X$ and $YM_2$ in a liquid medium and conditions favoring the precipitation of $(M_1)_a(M_2)_b$ and the retention of XY in the solution. The step of combining $M_1X$ and $YM_2$ may be carried out by forming a solution of each and adding them together or by forming a solution of $YM_2$ and adding $M_1X$ to the solution. Other typical techniques for combining starting materials which for a precipitate may also be used. The selection of X and Y will depend on the solvent. However, usually a halogen as X and an alkali metal as Y will provide desired results. Temperatures in the range of −40° C. to 40° C. may be used. Suitable solvents include alcohols such as methanol, ethanol and others with 3–4 carbon atoms and other polar organic solvents such as methylformamide and the like.

EXAMPLE I

The following is a detailed experimental description of the process using $Fe_2SnTe_4$ as an example.

All operations are carried out in an atmosphere of argon, inside a glove box, with strict exclusion of oxygen (<1 ppm). All solvents are thoroughly degassed by alternately exposure to vacuum and pure argon.

Anhydrous iron (II) bromide, $FeBr_2$ (2 g, 100% excess based on $K_4SnTe_4$) and $K_4SnTe_4$ (1 g) are each dissolved in methanol (5 mL for $FeBr_2$ and 30 mL for $K_4SnTe_4$). While holding at a temperature between −20° and +20° C., the $FeBr_2$ solution is added to the $K_4SnTe_4$ solution while stirring. A black precipitate forms and after stirring for 10 minutes is filtered and dried under vacuum (<0.01 torr) overnite. The product is a fine, black precipitate of $Fe_2SnTe_4$.

The foregoing description of embodiments of the invention has been presented for purposes of illustration and description. It is not intended to be exhaustive or to limit the invention to the precise form disclosed, and obviously many modifications and variations are possible in light of the above teaching.

The embodiments of this invention in which an exclusive property or privilege is claimed are defined as follows:

1. A process for preparing an amorphous metallic precipitate comprising the steps of forming a mixture of chemical compounds $M_1X$ and $M_2Y$ in a polar organic solvent, wherein $M_1$ is at least one transition metal having an atomic number in the range of 24–30, 45–48 and 77–80, $M_2$ is at least one metal selected from the group consisting of Sn, Pb, As, Sb, P, Te, Sc, S and mixtures thereof, and XY is soluble in the solvent, and forming $(M_1)_a(M_2)_b$ as said precipitate, the integers "a" and "b" providing stoichiometric balance in the precipitate.

2. The process of claim 1 including the step of pressing the precipitate into a flat sheet.

3. The process of claim 1 wherein the precipitation is at a temperature in the range of −40° C. to 40° C.

4. The process of claim 3 wherein the mixture of $M_1X$ and $M_2Y$ is formed in said solvent of an alcohol having 3–4 carbon atoms.

* * * * *